US011514793B2

(12) United States Patent
Shimizu

(10) Patent No.: US 11,514,793 B2
(45) Date of Patent: Nov. 29, 2022

(54) DISPLAY CONTROL APPARATUS AND VEHICLE CONTROL APPARATUS

(71) Applicant: DENSO CORPORATION, Kariya (JP)

(72) Inventor: Takahiro Shimizu, Kariya (JP)

(73) Assignee: DENSO CORPORATION, Kariya (JP)

( * ) Notice: Subject to any disclaimer, the term of this patent is extended or adjusted under 35 U.S.C. 154(b) by 8 days.

(21) Appl. No.: 15/768,223

(22) PCT Filed: Oct. 14, 2016

(86) PCT No.: PCT/JP2016/080612
§ 371 (c)(1),
(2) Date: Apr. 13, 2018

(87) PCT Pub. No.: WO2017/065297
PCT Pub. Date: Apr. 20, 2017

(65) Prior Publication Data

US 2018/0322787 A1 Nov. 8, 2018

(30) Foreign Application Priority Data

Oct. 16, 2015 (JP) ..... JP2015-204596

(51) Int. Cl.
*G08G 1/16* (2006.01)

(52) U.S. Cl.
CPC ..... *G08G 1/167* (2013.01); *G08G 1/165* (2013.01); *G08G 1/166* (2013.01)

(58) Field of Classification Search
CPC ..... G08G 1/167; G08G 1/166; G08G 1/165
USPC ..... 382/104
See application file for complete search history.

(56) References Cited

U.S. PATENT DOCUMENTS

2004/0193347 A1* 9/2004 Harumoto ..... G08G 1/16 701/45
2007/0154068 A1* 7/2007 Stein ..... G06V 20/58 348/148
2009/0112389 A1* 4/2009 Yamamoto ..... B60R 1/00 701/31.4
2010/0123778 A1 5/2010 Hada
2010/0253593 A1 10/2010 Seder et al.
2012/0072097 A1* 3/2012 Ohta ..... G08G 1/167 701/1
2012/0087546 A1* 4/2012 Focke ..... B60R 1/00 382/104

(Continued)

FOREIGN PATENT DOCUMENTS

DE 102007027495 A1 12/2008
DE 102013016242 A1 4/2015

(Continued)

*Primary Examiner* — Amandeep Saini
(74) *Attorney, Agent, or Firm* — Maschoff Brennan

(57) ABSTRACT

A display control apparatus is installed in an own vehicle to display an image on a display device viewed by a passenger of the own vehicle. The display control apparatus includes a boundary acquisition section that acquires positions of boundary portions defining both width-wise ends of a traveling lane in which the own vehicle travels, and an object acquisition section that acquires a position of an object around the traveling lane. The apparatus generates a position image, which is an image representing the positions of the boundary portions and the position of the object, and displays the position image on the display device.

13 Claims, 16 Drawing Sheets

(56) References Cited

U.S. PATENT DOCUMENTS

| | | | | |
|---|---|---|---|---|
| 2012/0154591 | A1* | 6/2012 | Baur | B60R 1/08 348/148 |
| 2012/0314055 | A1* | 12/2012 | Kataoka | G08G 1/167 382/104 |
| 2013/0054128 | A1* | 2/2013 | Moshchuk | B60W 10/18 701/301 |
| 2013/0197758 | A1* | 8/2013 | Ueda | G05D 1/0088 701/41 |
| 2014/0032049 | A1* | 1/2014 | Moshchuk | G08G 1/166 701/42 |
| 2014/0226015 | A1* | 8/2014 | Takatsudo | B60R 1/00 348/148 |
| 2015/0103174 | A1 | 4/2015 | Emura et al. | |
| 2016/0098837 | A1* | 4/2016 | Saiki | G06T 7/73 348/87 |
| 2017/0132922 | A1* | 5/2017 | Gupta | G06F 3/0482 |
| 2018/0170429 | A1 | 6/2018 | Shimizu | |

FOREIGN PATENT DOCUMENTS

| | | | | |
|---|---|---|---|---|
| JP | 2005-056372 | A | | 3/2005 |
| JP | 2008-059458 | A | | 3/2008 |
| JP | 2008059458 | A | * | 3/2008 |
| JP | 2009-083680 | | | 4/2009 |
| JP | 2010-173530 | | | 8/2010 |
| JP | 2013-120574 | A | | 6/2013 |
| JP | 5316713 | B2 | | 10/2013 |
| JP | 2014-133512 | | | 7/2014 |
| JP | 5616531 | B2 | | 10/2014 |
| JP | 2015-096946 | A | | 5/2015 |

* cited by examiner

DISPLAY CONTROL APPARATUS AND VEHICLE CONTROL APPARATUS

TECHNICAL FIELD

The present invention relates to a display control apparatus that displays an image on a display device viewed by a passenger of an own vehicle and a vehicle control apparatus that controls the own vehicle.

BACKGROUND ART

As the display control apparatus, there is known a display control apparatus that recognizes white lines as boundaries of a traveling lane and displays an image of a recognition state of the white lines as described in Patent Literature 1, for example.

CITATION LIST

Patent Literature

[Patent Literature 1] Japanese Patent No. 5316713

SUMMARY OF THE INVENTION

Technical Problem

For the above display control apparatus, there is a demand that a passenger is allowed to recognize a lot of things by taking a glance at the image.

Solution to Problem

In an embodiment of the present invention, a display control apparatus displaying an image on a display device viewed by a passenger of an own vehicle can display more items.

A display control apparatus of the embodiment is installed in an own vehicle to display an image on a display device viewed by a passenger of the own vehicle. The display control apparatus includes a boundary acquisition section that acquires positions of boundary portions defining both width-wise ends of a traveling lane in which the own vehicle travels, and an object acquisition section that acquires a position of an object around the traveling lane. The apparatus generates a position image, which is an image representing the positions of the boundary portions and the position of the object, and displays the position image on the display device.

DESCRIPTION OF EMBODIMENTS

Embodiments of the present invention will be described below with reference to the drawings.

1. First Embodiment

1-1. Configuration

A deviation avoidance system 2 to which the present invention is applied is installed in a vehicle such as a passenger automobile and has a function of suppressing a deviation of the vehicle from a traveling lane in which the vehicle travels. It is noted that the traveling lane refers to an area closer to the own vehicle than boundary portions that define the right and left ends of an area in which the own vehicle is supposed to travel.

The deviation avoidance system 2 of the present embodiment is configured to display more items on a display 40 to improve convenience. It is noted that, in the present embodiment, "suppressing a deviation" is also expressed as "avoiding a deviation".

Figure 1:
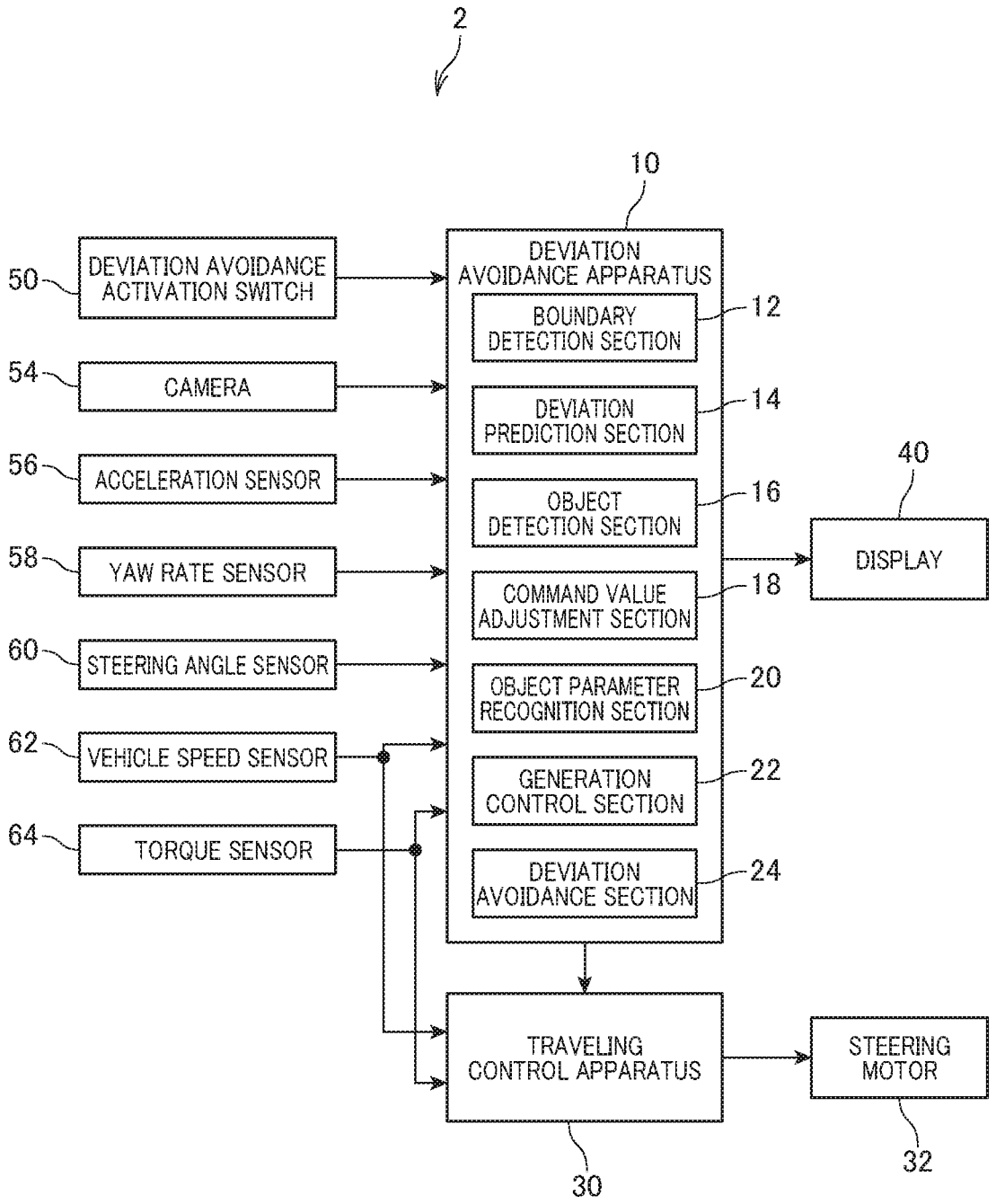
FIG. 1 is a block diagram of a deviation avoidance apparatus according to a first embodiment.

As shown in FIG. 1, the deviation avoidance system 2 includes a deviation avoidance apparatus 10, a traveling control apparatus 30, a steering motor 32, the display 40, a deviation avoidance activation switch 50, a camera 54, an acceleration sensor 56, a yaw rate sensor 58, a steering angle sensor 60, a vehicle speed sensor 62, and a torque sensor 64.

The deviation avoidance apparatus 10 is a well-known computer that includes a CPU and memories such as a RAM and a ROM. The deviation avoidance apparatus 10 performs a deviation avoidance process described later by a program stored in the memory. Performing this program performs a method corresponding to the program. One or more microcomputers may configure the deviation avoidance apparatus 10.

In the following description, a vehicle equipped with the deviation avoidance apparatus 10 will be referred to as an own vehicle. It is noted that the memory stores in advance a plurality of kinds of icons. The icons refer to simply symbolized pictures. Specifically, the icons include images of a white line as a boundary, a pedestrian, a vehicle, a guard rail, suitability boundaries described later, and the like. These elements of the deviation avoidance apparatus 10 may not necessarily be implemented by software. Some or all of the elements may be implemented by hardware in combination with logical circuits or analog circuits.

The deviation avoidance apparatus 10 functionally includes a boundary detection section 12, a deviation prediction section 14, an object detection section 16, a command value adjustment section 18, an object parameter recognition section 20, a generation control section 22, and a deviation avoidance section 24. The functions of the sections of the deviation avoidance apparatus 10 will be described later.

The traveling control apparatus 30 acquires steering torque generated by the operation of the steering wheel of the driver from the torque sensor 64 and acquires a vehicle speed of an own vehicle 100 from the vehicle speed sensor 62. Then, the traveling control apparatus 30 calculates assist torque output from the steering motor 32 that assists the steering operation of the driver based on the steering torque and the vehicle speed. The traveling control apparatus 30 controls the steering motor 32 by power distribution in accordance with the calculated result to control the amount of assist for the driver to turn the steering wheel.

To avoid the deviation of the own vehicle from the traveling lane in which the own vehicle is traveling, the traveling control apparatus 30 controls the amount of power distribution to the steering motor 32 by a command issued from the deviation avoidance apparatus 10 to control the traveling state of the own vehicle. The steering motor 32 corresponds to a steering actuator that drives a steering mechanism to change the traveling direction of the own vehicle.

The traveling control apparatus 30 controls not only the power distribution to the steering motor 32 but also a brake system and a power train system, which are not shown, to control the traveling state of the own vehicle. The traveling state of the own vehicle includes longitudinal and lateral vehicle speeds of the own vehicle, a lateral position of the own vehicle in the traveling lane, and longitudinal and lateral accelerations of the own vehicle.

The deviation avoidance activation switch 50 is provided on a front panel, for example. When the deviation avoidance activation switch 50 is turned on, the deviation avoidance apparatus 10 starts the deviation avoidance process. At this time, the performance of the deviation avoidance assist is indicated on the display 40. It is noted that the display 40 may be a display of a navigation system, which is not shown, or may be a display dedicated to the deviation avoidance process.

The camera 54 images an area ahead of the own vehicle 100. The deviation avoidance apparatus 10 analyzes image data of the image captured by the camera 54. The acceleration sensor 56 detects longitudinal and lateral accelerations of the own vehicle 100. The yaw rate sensor 58 detects a turning angle velocity of the own vehicle 100.

The steering angle sensor 60 detects a steering angle of a steering wheel (not shown). The vehicle speed sensor 62 detects a current vehicle speed of the own vehicle 100. The torque sensor 64 detects torque generated by steering operation of the driver.

1-2. Process

The deviation avoidance process performed by the deviation avoidance apparatus 10 will be described. The deviation avoidance process is performed at predetermined time intervals when the deviation avoidance activation switch 50 is turned on.

Figure 2:
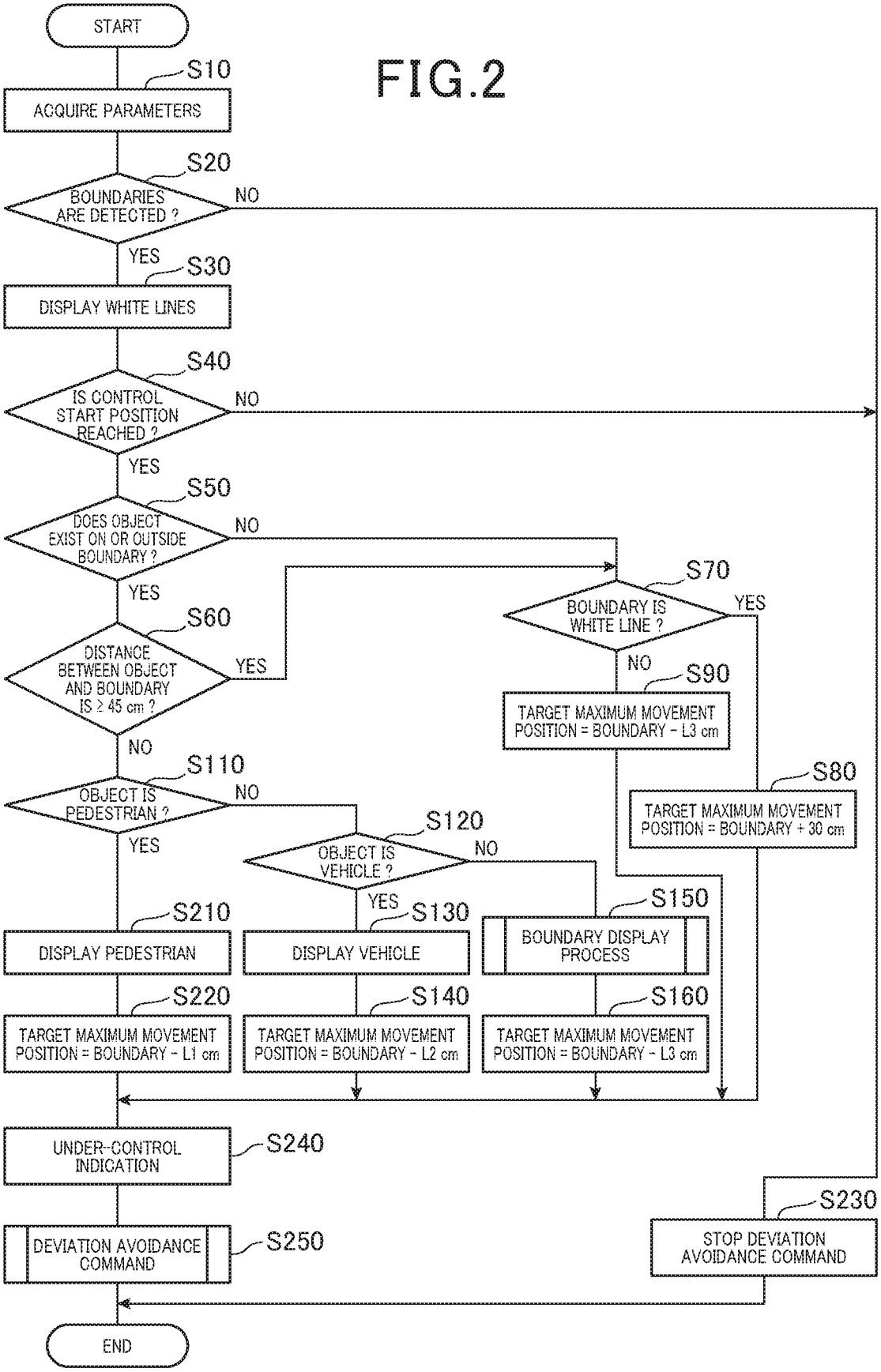
FIG. 2 is a flowchart of a deviation avoidance process according to the first embodiment.
Figure 3:
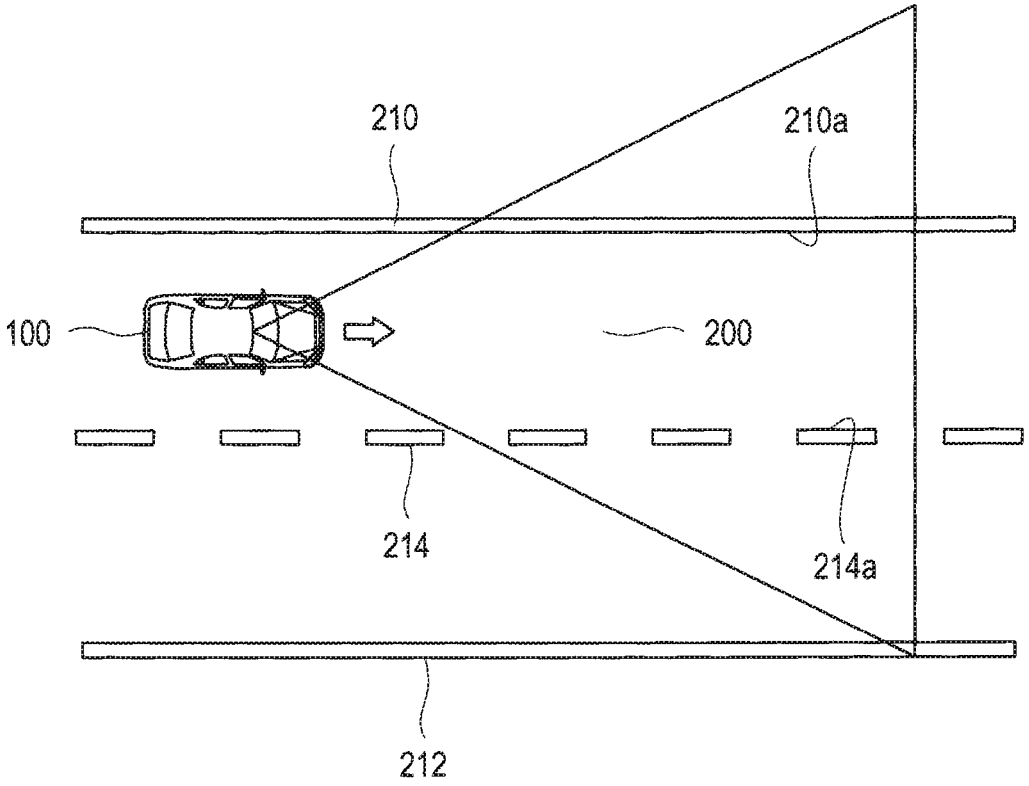
FIG. 3 is a schematic diagram illustrating an imaging range of a camera.
Figure 4:
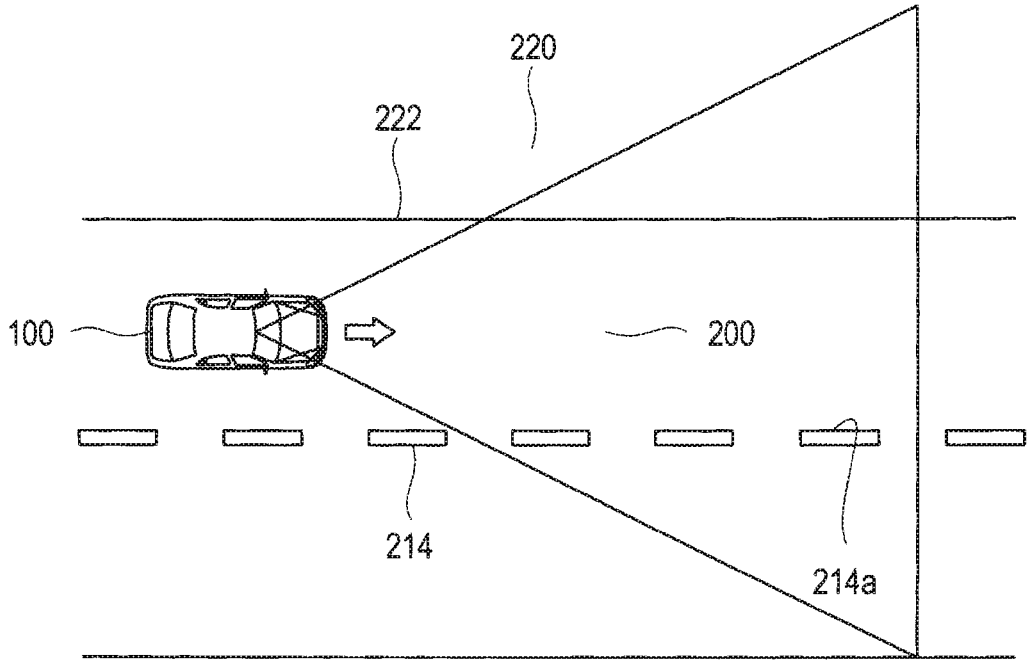
FIG. 4 is a schematic diagram illustrating another imaging range of the camera.

In the deviation avoidance process, as described in FIG. 2, the deviation avoidance apparatus 10 first acquires various parameters in S10. The boundary detection section 12 detects boundaries of a traveling lane 200 in which the own vehicle 100 is traveling from the image data captured by the camera 54, as shown in FIGS. 3 and 4. The object detection section 16 detects the location and type of an object included in the image data.

For example, the object detection section 16 detects a distance between the own vehicle 100 and the object based on the position of the lower end of the object in the image captured by the camera 54. The distance between the own vehicle 100 and the object can be determined as longer, as the lower end of the object is positioned more upward in the captured image. In addition, the object detection section 16 determines the kind of the object by, for example, pattern matching using a dictionary of object models pre-stored therein.

In addition, the object parameter recognition section 20 keeps track of the position and type of the object in a time-series manner to recognize a relative movement vector of the object to the own vehicle. In addition, the object parameter recognition section 20 also recognizes the distance between the object and the boundary of the traveling lane, that is, to what degree the object is separated outwardly from the boundary. In S10, the deviation avoidance apparatus 10 acquires, as the various parameters, the positions of the boundaries, the position and type of the object, the relative movement vector, the distance between the object and the boundary of the traveling lane, and the like.

Then, in S20, the boundary detection section 12 determines whether the boundaries of the traveling lane 200 in which the own vehicle 100 is traveling have been successfully detected. The boundaries of the traveling lane 200 define both ends in the width direction of the traveling lane 200.

Referring to FIG. 3, the boundaries defining both ends in the width direction of the traveling lane 200 are set, of right and left white lines 210 and 212 and a center line 214 of the road, to an inner end 210*a* of the left white line 210 and an inner end 214*a* of the center line 214. The white lines 210 and 212 and the center line 214 of the road are recognized by analysis of the image data, for example. The boundaries are not limited to the inner ends 210*a* and 214*a* but may be set to arbitrary preset positions on the white line 210 and the center line 214 such as the outer ends of the white line 210 and the center line 214.

Referring to FIG. 4, there is no white line on the left side of the own vehicle 100, the left side being one end side of both sides in the width direction of the traveling lane 200, but the boundary between a paved surface suitable for traveling and an unsuitable section 220 for traveling is detected as a suitability boundary 222 of the traveling lane 200 defined based on the suitability for traveling. It is noted that the inner end 210*a* of the white line 210 and the suitability boundary 222 may be collectively and simply referred to as a boundary.

For a traveling lane without the center line 214 as shown in FIG. 4 as a traveling lane without white lines, for example, the boundary between the paved surface and the unsuitable section for traveling is detected as a suitability boundary on both sides in the width direction of the traveling lane.

When the own vehicle 100 travels on the right side of the road in the example of FIG. 4, the boundary between the paved surface and the unsuitable section for traveling is detected as a suitability boundary on the right side which is one end side of the both sides in the width direction of the traveling lane in which the own vehicle 100 is traveling.

The suitability boundary 222 between the paved surface and the unsuitable section 220 for traveling is recognized, for example, based on the analysis of the image data by the boundary detection section 12 or the object detection section 16. The boundary on the right side of the both ends in the width direction of the traveling lane 200 with respect to the own vehicle 100 is defined by the inner end 214*a* of the center line 214.

In this manner, when no white line exists on at least one of the both ends in the width direction of the traveling lane 200, the boundary between the suitable section for traveling of the own vehicle 100 and the unsuitable section 220 for traveling of the own vehicle 100 at the end side is set as the suitability boundary 222 of the traveling lane 200 defined by the suitability for traveling.

The suitable section for traveling of the own vehicle 100 refers to a paved surface or a road surface that is not paved but is leveled to a degree that the own vehicle 100 can travel. The unsuitable section 220 for traveling of the own vehicle 100 refers to a section where the own vehicle 100 cannot run or has difficulty in traveling because of its structure with the presence of a wall, a building, a guard rail, lane-defining poles, a groove, a step, a cliff, or a sandy place.

The boundary detection section 12 detects the width of the traveling lane 200 as well as the boundaries of the traveling lane 200. The boundary detection section 12 further detects the coordinates of the boundaries of the traveling lane 200 within the range of the image captured by the camera 54. The boundary detection section 12 then calculates a curvature of the traveling lane 200 based on the coordinates of the boundaries. The boundary detection section 12 may acquire a curvature of the traveling lane 200 based on map information of a navigation system, which is not shown.

The boundary detection section 12 further detects, for example, a lateral position of the own vehicle 100 with respect to the boundaries or center line of the traveling lane 200 as a reference point of the traveling lane 200, based on the image data.

In S20, when the boundary detection section 12 cannot detect the boundaries of the traveling lane 200, the present process proceeds to S230. In S230, the deviation avoidance section 24 instructs the traveling control apparatus 30 to stop the deviation avoidance control for avoiding the deviation of the own vehicle 100 to the outside of the traveling lane 200, and then the present process is terminated. Instructing the traveling control apparatus 30 to stop the deviation avoidance control includes causing the traveling control apparatus 30 to continue the current traveling control while the traveling control apparatus 30 is not performing the deviation avoidance control.

For example, when it is not possible to detect a boundary between the paved surface and the unpaved surface of the traveling lane on which a white line is discontinued or a white line is not present, the boundary detection section 12 determines that the boundary of the traveling lane cannot be detected.

Figure 5A:
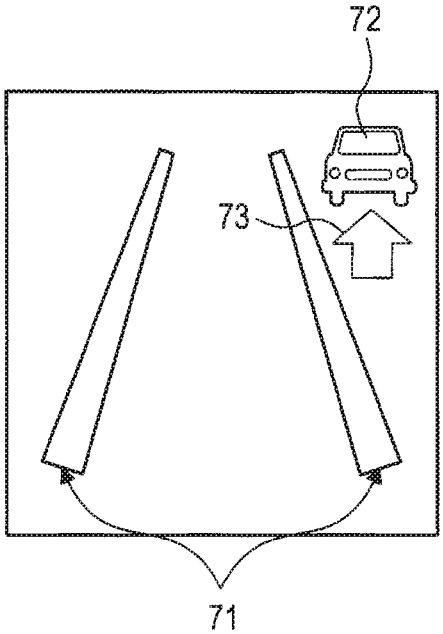
FIG. 5A is a diagram showing a display example in a case where an object is a parallel travelling vehicle.

In S20, when the boundary of the traveling lane 200 can be detected, the present process proceeds to S30. In S30, the generation control section 22 generates an image representing a recognition state of white lines as a mode of boundaries and displays the generated image on the display 40. For example, when the white lines on the right and left sides of the traveling lane can be recognized, as shown in FIG. 5A, the generation control section 22 displays white line icons 71, which are prepared images, on the display 40.

When one of the right and left white lines cannot be recognized, the generation control section 22 displays an image different from the white line icon 71 for the unrecognized side, for example, such as a line narrower than the white line icon 71, on the display 40. That is, the generation control section 22 separately generates the image representing the recognition state of the white line on the right side of the own vehicle and the image representing the recognition state of the left side of the own vehicle, and displays the images on the display 40. The images displayed on the display 40 constitute position images representing the positions of the white lines and objects.

Then, in S40, the deviation prediction section 14 determines whether the own vehicle 100 will deviate depending on whether the own vehicle 100 has reached a control start position where the deviation avoidance section 24 causes the traveling control apparatus 30 to start the deviation avoidance control. The control start position defines the timing for the traveling control apparatus 30 to start the deviation avoidance control.

The control start position is determined from a map, as the distance from the boundary on the deviation side to the inside of the traveling lane 200, for example, by using the lateral speed of the own vehicle 100, the curvature of the traveling lane 200, the width of the traveling lane 200 and the like as parameters.

Figure 6:
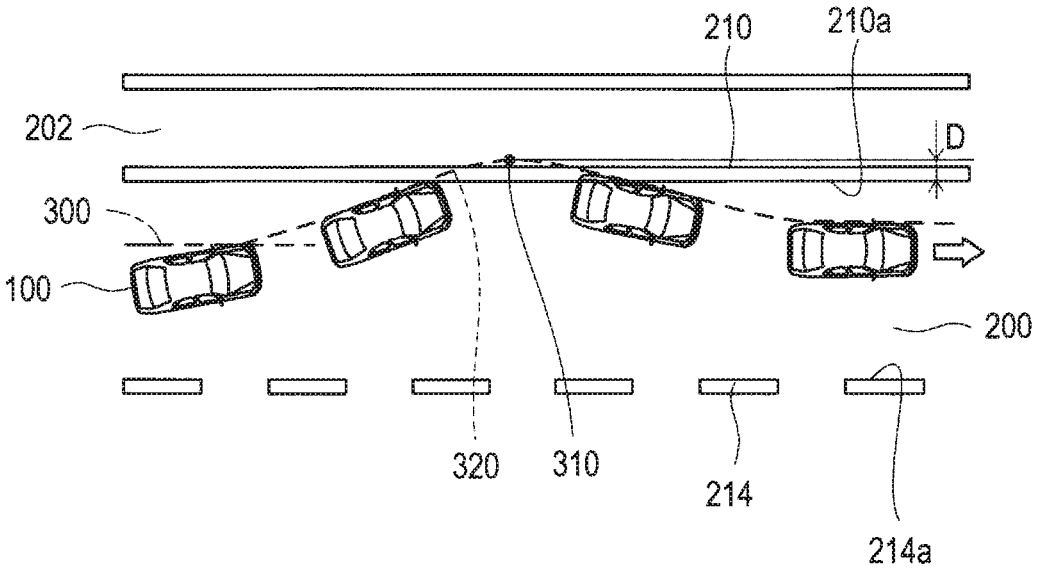
FIG. 6 is a schematic diagram illustrating deviation avoidance traveling without an object outside a traveling lane.

FIG. 6 indicates, for example, the control start position with reference sign 300. When the outer end of the front wheel of the own vehicle 100 on the deviation side has reached the control start position 300, the deviation prediction section 14 predicts that the own vehicle 100 has reached the control start position 300 and predicts that the own vehicle 100 will deviate from the road 200. The control start position 300 refers to the position where, when the own vehicle 100 moves from the control start position 300 at the current lateral speed, for example, the own vehicle 100 will reach the boundary of the traveling lane in a preset arrival time.

When it is determined in S40 that the own vehicle 100 has not reached the control start position 300, the present process proceeds to S230. In S230, the deviation avoidance section 24 causes the traveling control apparatus 30 to stop the deviation avoidance control, and then the present process is terminated.

When it is determined in S40 that the own vehicle 100 has reached the control start position 300, the deviation prediction section 14 predicts that the own vehicle 100 will deviate to the outside of the traveling lane 200. In this case, in S50 and S60, the deviation prediction section 14 determines whether any object exists on or outside the boundary on the deviation side.

When it is determined in S50 that no object exists on and outside the boundary on the deviation side, the present process proceeds to S70 described later. When it is determined in S50 that any object exists on or outside the boundary on the deviation side, the present process proceeds to S60 in which the deviation prediction section 14 determines the distance between the object and the boundary of the traveling lane, that is, to what degree the object is separated outward from the boundary. That is, the deviation prediction section 14 determines whether the distance between the object and the boundary is equal to or more than a permitted distance at which the own vehicle 100 is allowed to deviate to the outside of the boundary when no object exists on or outside the boundary. In the present embodiment, the permitted distance is set to 45 cm.

When it is determined in S60 that the distance between the object and the boundary is equal to or more than the permitted distance, the present process proceeds to S70. In S70, the object parameter recognition section 20 determines whether the detected boundary of the traveling lane 200 on the deviation side is a white line. In this process, the white line includes a center line and yellow line.

When it is determined in S70 that the boundary is a white line, the present process proceeds to S80. In S80, the object parameter recognition section 20 sets a command value for commanding the traveling control apparatus 30 to avoid the deviation of the own vehicle 100. For example, as shown in FIG. 6, the object parameter recognition section 20 sets a target maximum movement position 310 to a position whose distance D from the inner end 210*a* of the white line 210 on the deviation side is +30 cm. The own vehicle 100 reaches the target maximum movement position 310 when moving to the deviation side from the boundary on the deviation side to the outside of the traveling lane 200.

Upon completion of this step, the present process proceeds to S240. The plus sign of +30 cm indicates the outside of the traveling lane 200 from the inner end 210*a* of the white line 210 on the deviation side.

Figure 7:
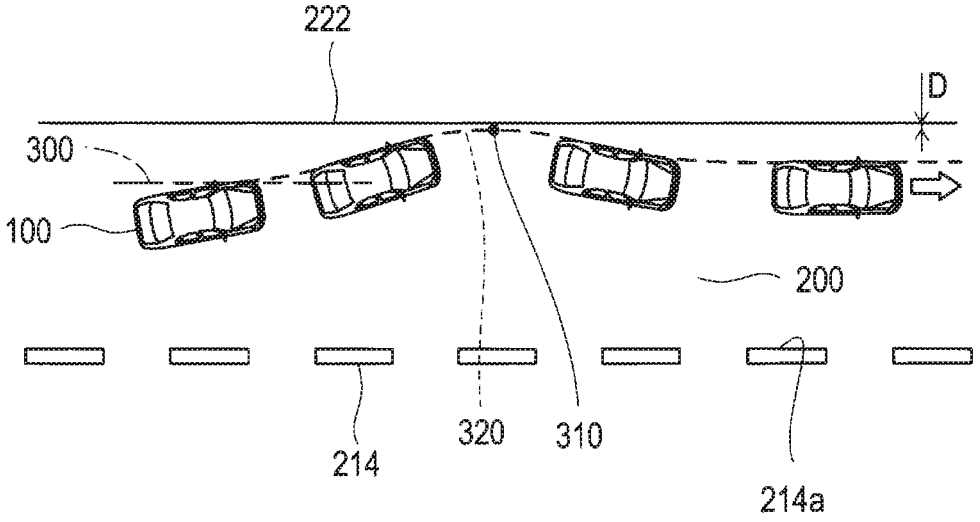
FIG. 7 is a schematic diagram illustrating other deviation avoidance traveling without an object outside the traveling lane.

When it is determined in S70 that the boundary is other than a white line, the object parameter recognition section 20 sets a command value for commanding the traveling control apparatus 30 to avoid the deviation of the own vehicle 100. For example, as shown in FIG. 7, the object parameter recognition section 20 sets the target maximum movement position 310 to a position whose distance D with respect to the suitability boundary 222 on the deviation side is "the boundary—L3 cm". Upon completion of this step, the present process proceeds to S240.

Since L3 is a positive value, the set target position 310 indicates the inside of the traveling lane 200 from the suitability boundary 222 on the deviation side. L3 cm is set to, for example, 5 cm.

In contrast, in S60, when the distance between the object and the boundary is less than the permitted distance, the present process proceeds to S110, in which the object detection section 16 determines whether the object is a pedestrian.

When it is determined in S110 that the object is not a pedestrian, the present process proceeds to S120, in which the object detection section 16 determines whether the object is a vehicle. When the object is a vehicle, the object parameter recognition section 20 determines whether the vehicle is a parked vehicle, a parallel vehicle traveling in the same direction as that of the own vehicle, or an oncoming vehicle that is traveling in the opposite direction of the own vehicle, based on the relative speed between the own vehicle and the object.

In S120, when the object is a vehicle, the process proceeds to S130, in which the generation control section 22 reads a vehicle icon 72, which is a picture representing a vehicle, from the memory and displays the image thereof on the display 40. More specifically, as shown in FIG. 5A, the generation control section 22 arranges the vehicle icon 72 at a position corresponding to the positional relationship with the boundary such as a white line, and displays an arrow image 73 representing the relative movement direction of the vehicle around the vehicle icon 72. In the arrow image, the arrow indicates the relative movement direction of the vehicle.

Figure 5B:
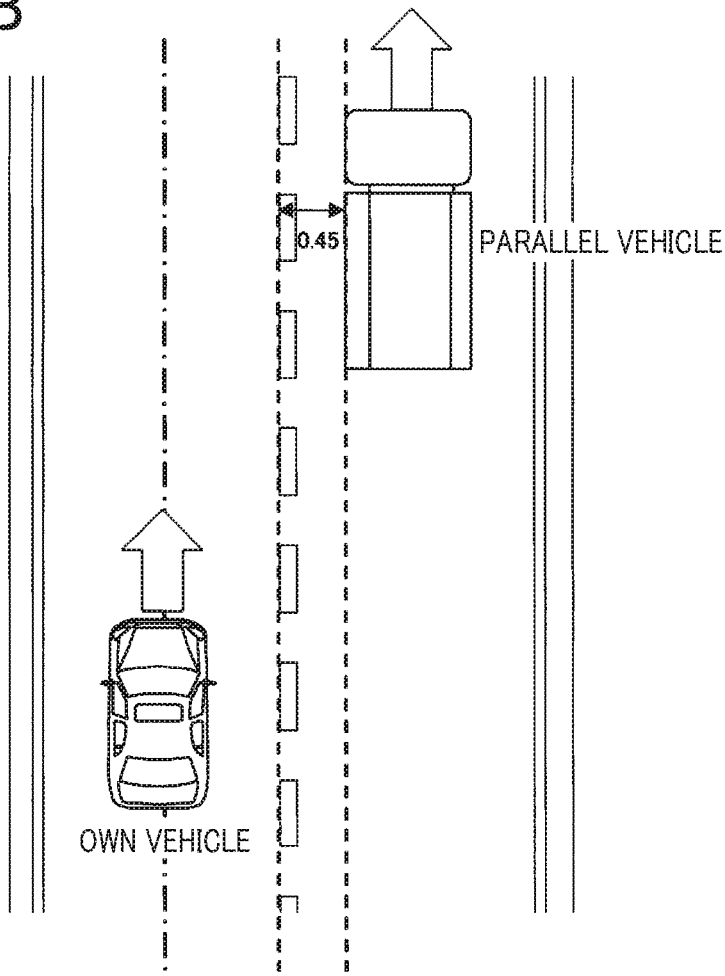
FIG. 5B is a plan view showing surroundings of an own vehicle in the case where the object is a parallel travelling vehicle.

The example of the image shown in FIG. 5A indicates a situation in which a vehicle is traveling parallel to the own vehicle on a traveling lane adjacent to the traveling lane of the own vehicle at a higher speed than that of the own vehicle, as shown in FIG. 5B. The image shown in FIG. 5A represents the recognition state of the white lines, the positional relationship between the white lines and the object, the relative movement direction of the object, the type of the object and the like.

Then, in S140, the object parameter recognition section 20 sets a command value for commanding the traveling control apparatus 30 to avoid the deviation of the own vehicle 100. For example, the object parameter recognition section 20 sets the target maximum movement position 310 to a position whose distance D with respect to the boundary is "the boundary—L2 cm", where the boundary is the inner end 210*a* of the white line 210 on the deviation side, and the present process proceeds to S240. L2 is a positive value, and the relationship L1>L2>L3 is established. L2 cm is set to, for example, 10 cm.

When it is determined in S120 that the object is not a vehicle, the present process proceeds to S150 to perform a boundary display process. The boundary display process is a process for displaying an image in accordance with the type of an object that is other than a vehicle and a pedestrian.

Figure 8:
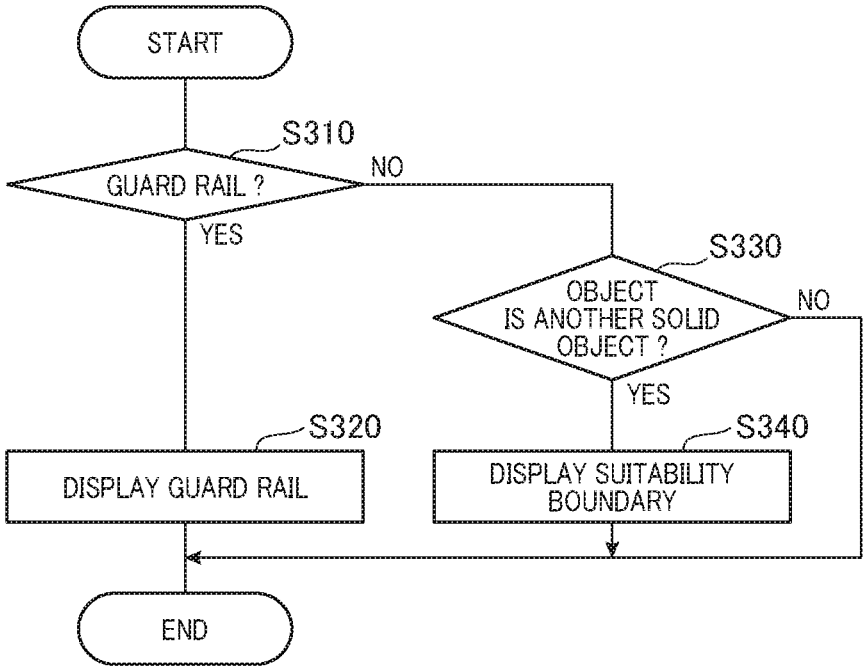
FIG. 8 is a flowchart of a boundary display process.

In the boundary display process, as shown in FIG. 8, in S310, the object parameter recognition section 20 first determines whether the detected object is a guard rail. When it is determined in S310 that the object is a guard rail, the present process proceeds to S320. In S320, the generation control section 22 displays an image representing a guard rail on the display 40, and the boundary display process is terminated.

Figure 9A:
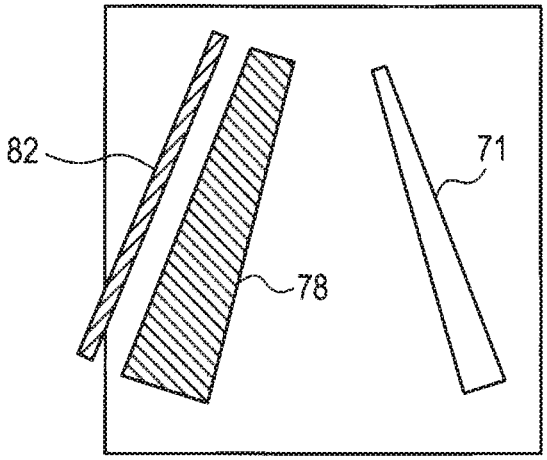
FIG. 9A is a diagram showing a display example in a case where a white line and a guard rail are detected.
Figure 9B:
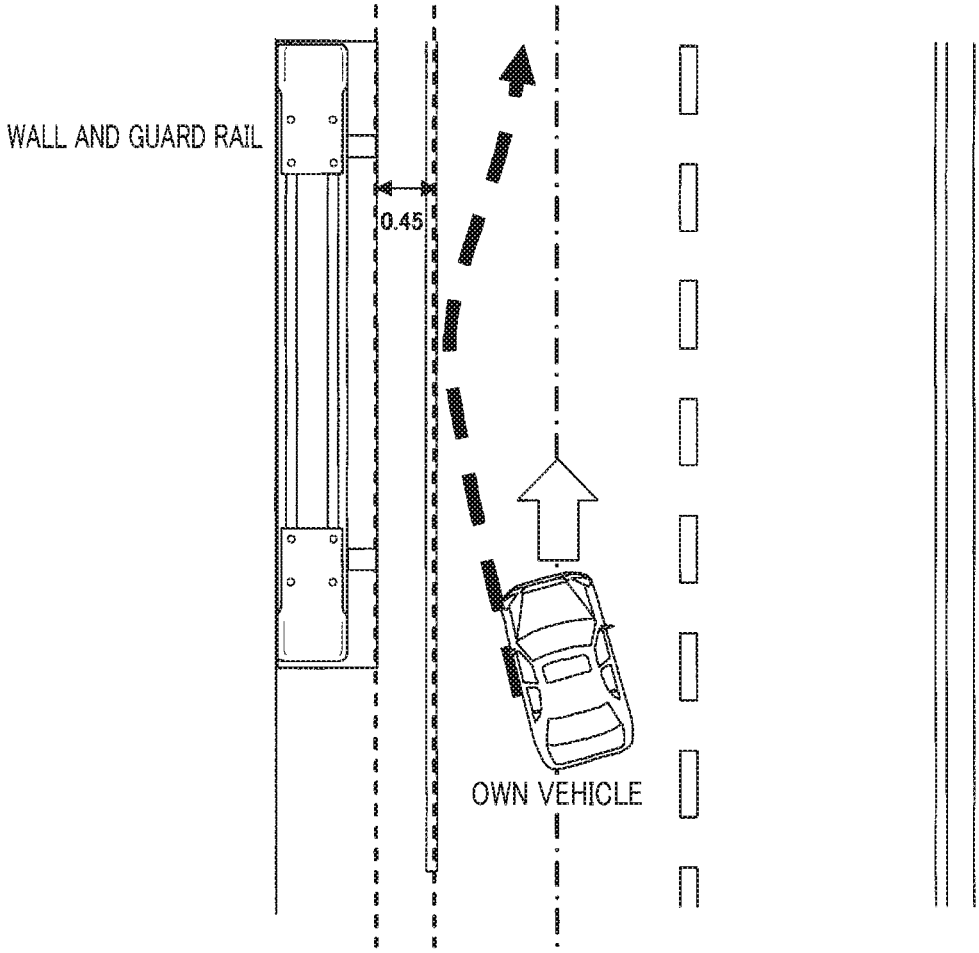
FIG. 9B is a plan view showing surroundings of the own vehicle in the case where a white line and a guard rail are detected.

As the image representing a guard rail, when a white line and a guard rail are detected on one side of the vehicle as shown in FIG. 9B, for example, an image including both the icons representing them may be generated and displayed as shown in FIG. 9A. In the example of FIG. 9A, the white icon 71 is displayed on the right side of the own vehicle, and an under-control icon 78, which indicates that the white line is recognized and that the deviation avoidance control is being performed, and a guard rail icon 82, which represents the guard rail, are displayed on the left side of the own vehicle.

When it is determined in S310 that the detected object is not a guard rail, the present process proceeds to S330, in which the object parameter recognition section 20 determines whether the object is another solid object. Another solid object refers to the above-described unsuitable section 220 for traveling of the own vehicle 100.

When it is determined in S330 that the object is another solid object, the present process proceeds to S340. In S340, the generation control section 22 displays an image representing the suitability boundary 222 on the display 40, and then the boundary display process is terminated.

Figure 10A:
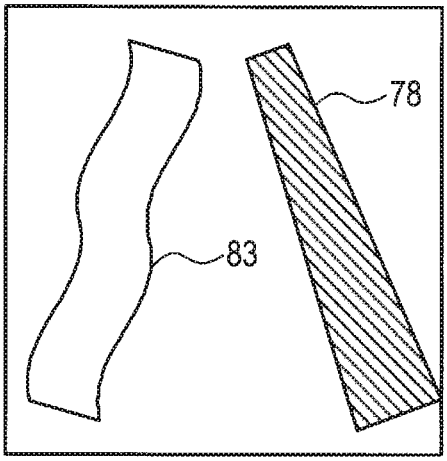
FIG. 10A is a diagram showing a display example of a suitability boundary.
Figure 10B:
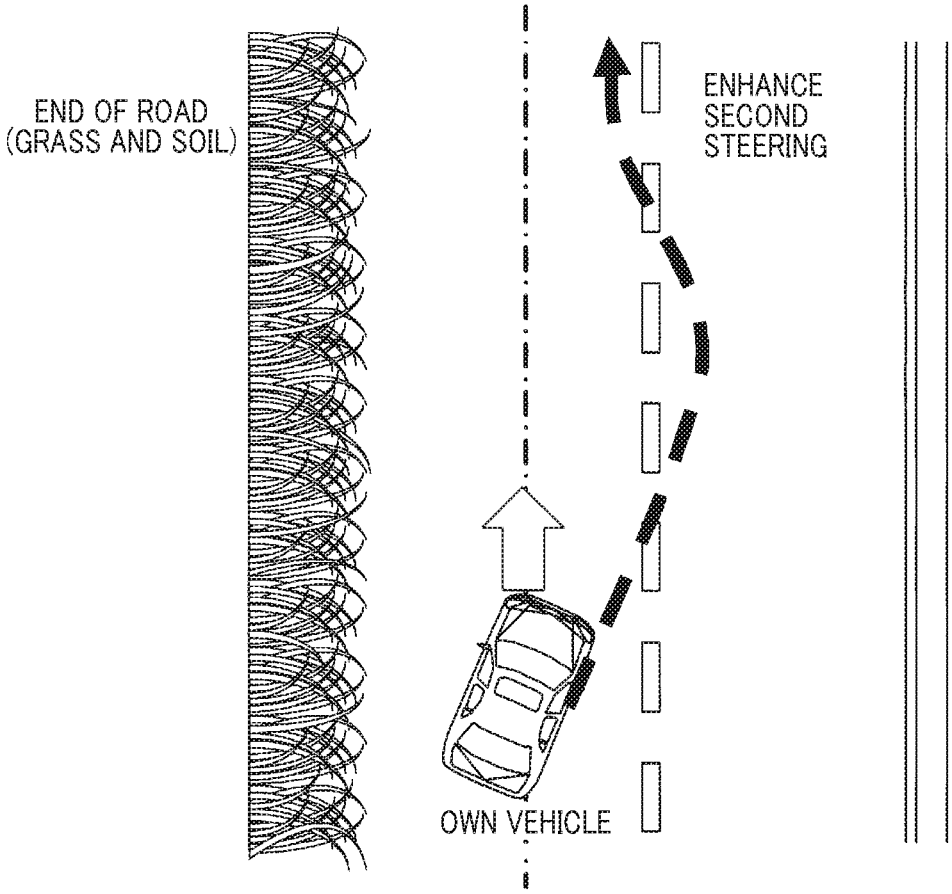
FIG. 10B is a plan view showing surroundings of the own vehicle in the presence of the suitability boundary.

In a possible situation where the suitability boundary 222 is displayed, for example, a grass field or the like is present on the left end of the road as shown in FIG. 10B. In such a case, as shown in FIG. 10A, the generation control section 22 displays a suitability boundary icon 83 representing the suitability boundary 222. When it is determined in S330 that the object is not another solid object, the boundary display process is terminated.

Next, returning to FIG. 2, in S160, the object parameter recognition section 20 sets a command value for commanding the traveling control apparatus 30 to avoid the deviation of the own vehicle 100. For example, the object parameter recognition section 20 sets the target maximum movement position 310 to a position whose distance D with respect to the boundary between the traveling lane 200 and a pole 230 is "the boundary—L3 cm". Then, the present process proceeds to S240.

Figure 11A:
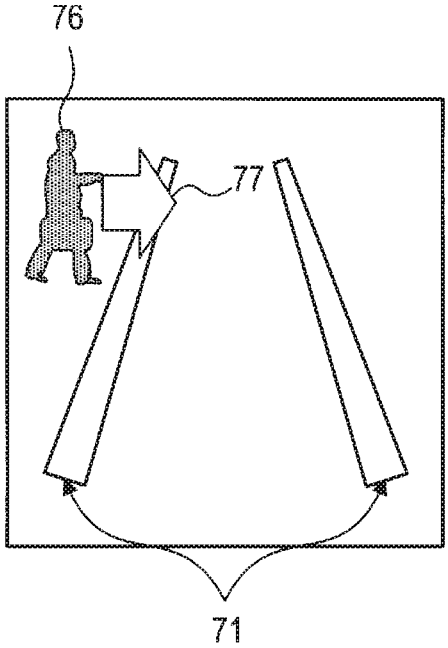
FIG. 11A is a diagram showing a display example in a case where the object is a person.

When it is determined in S110 that the object is a pedestrian 110, the present process proceeds to S210. In S210, the generation control section 22 displays an image representing a pedestrian on the display 40. For example, as shown in FIG. 11A, the image representing a pedestrian is a pedestrian icon 76, which is a picture representing a pedestrian and prepared in the memory. At this time, the generation control section 22 displays an arrow icon 77 representing the movement direction of the pedestrian as well.

Figure 11B:
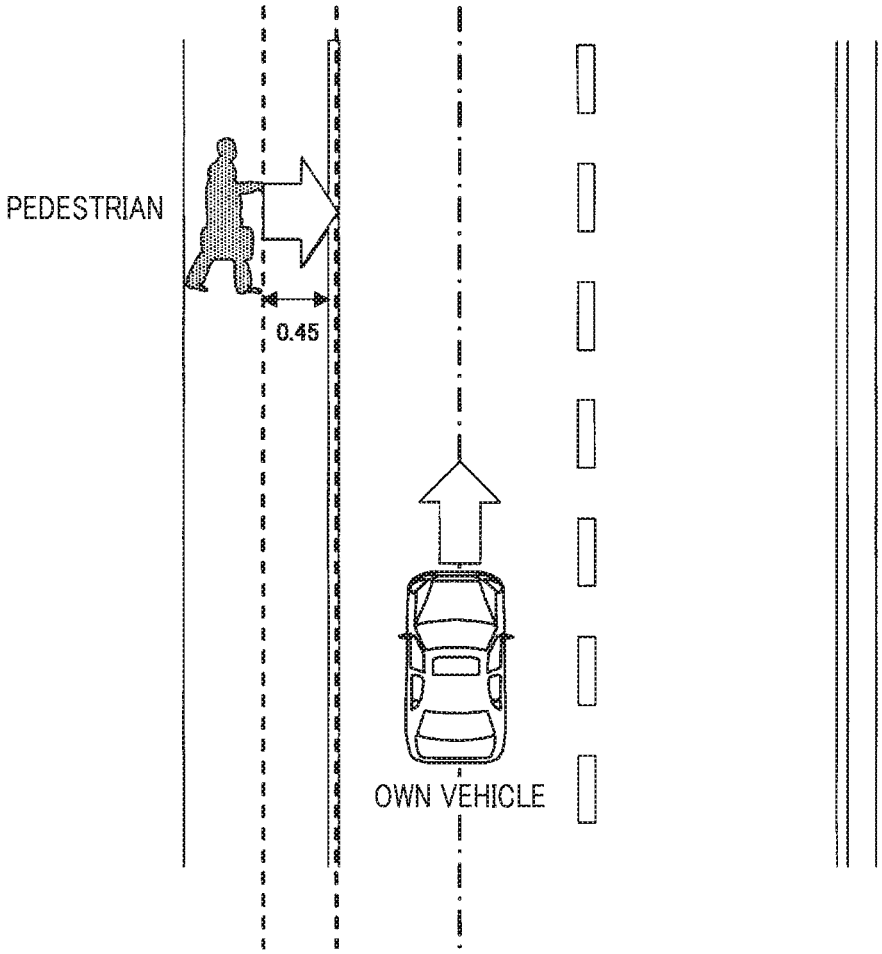
FIG. 11B is a plan view showing surroundings of the own vehicle in the case where the object is a person.

Both the pedestrian icon 76 and the white line icon 71 are displayed, for example, only when a person such as a pedestrian is located within 45 cm from the white line as shown in FIG. 11B. This is because only the person necessary for performance of the control needs to be displayed as the pedestrian icon 76. The movement direction of the pedestrian is recognized by performing pattern matching with a pedestrian dictionary for estimating the movement direction from the shape of the pedestrian or by tracking the images in a time-series manner.

Figure 12:
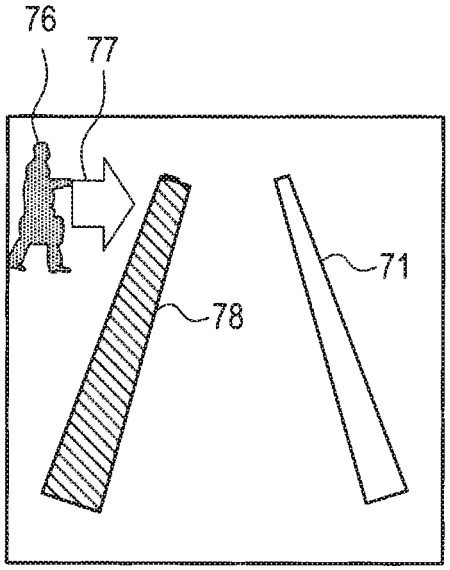
FIG. 12 is a diagram showing a display example in a case where the own vehicle is under deviation avoidance.

Then, in S240, the generation control section 22 provides an under-control indication. The under-control indication is an indication that the deviation avoidance control is being performed. In this process, as shown in FIG. 12, for example, the under-control icon 78 is emphatically displayed which is one of the right and left white icons 71 and is on the deviation side. In the example of FIG. 12, the under-control icon 78 is devised to represent the left white line on the deviation side and attract the driver's attention by changing the color of the white line icon 71 or flashing the white line icon 71.

Next, in S220, the object parameter recognition section 20 sets a command value for commanding the traveling control apparatus 30 to avoid the deviation of the own vehicle 100. For example, the object parameter recognition section 20 sets the target maximum movement position 310 to a position whose distance D with respect to the boundary is "the boundary—L1 cm", where the boundary is the inner end 210*a* of the white line 210 on the deviation side, and the present process proceeds to S240. L1 is a positive value, and the relationship L1>L3 is established. L1 cm is set to, for example, 15 cm.

Next, in S250, the deviation avoidance section 24 commands the traveling control apparatus 30 to set a target line 320 on which the own vehicle 100 travels during the deviation avoidance process. The traveling control apparatus 30 performs the deviation avoidance control with feedback control on power distribution to the steering motor 32 so that the own vehicle 100 can run on the commanded target line 320.

Figure 13:
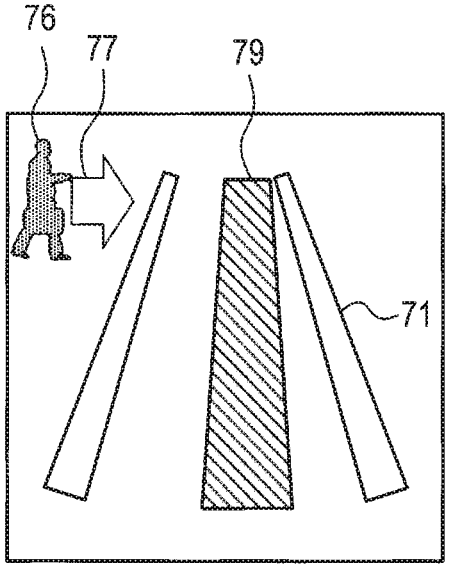
FIG. 13 is a diagram showing a display example in a case where the own vehicle is under offset control.

When a person is detected within a predetermined distance from the white line, the deviation avoidance section 24 performs offset control to move the lateral position of the own vehicle to the side distant from the person in the traveling lane. In this case, as shown in FIG. 13, for example, the generation control section 22 displays an offset icon 79 indicating that the offset control is being performed. When a pedestrian is detected on the left side of the traveling lane, for example, the traveling position is offset about 20 cm to the right side in the width direction.

Figure 14A:
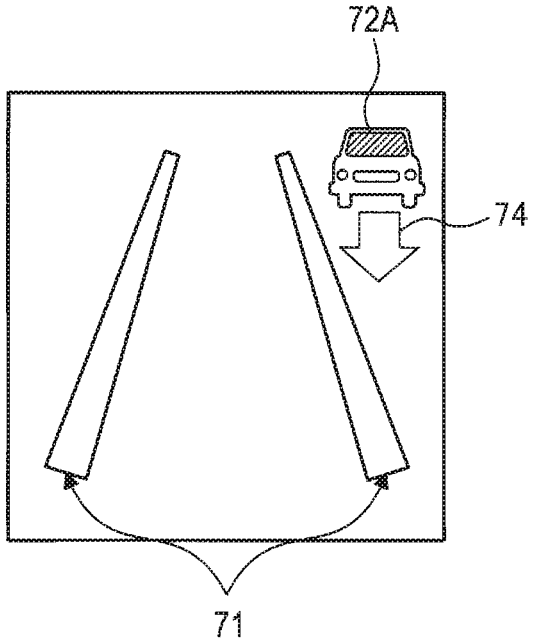
FIG. 14A is a diagram showing a display example in a case where the object is an oncoming vehicle.
Figure 14B:
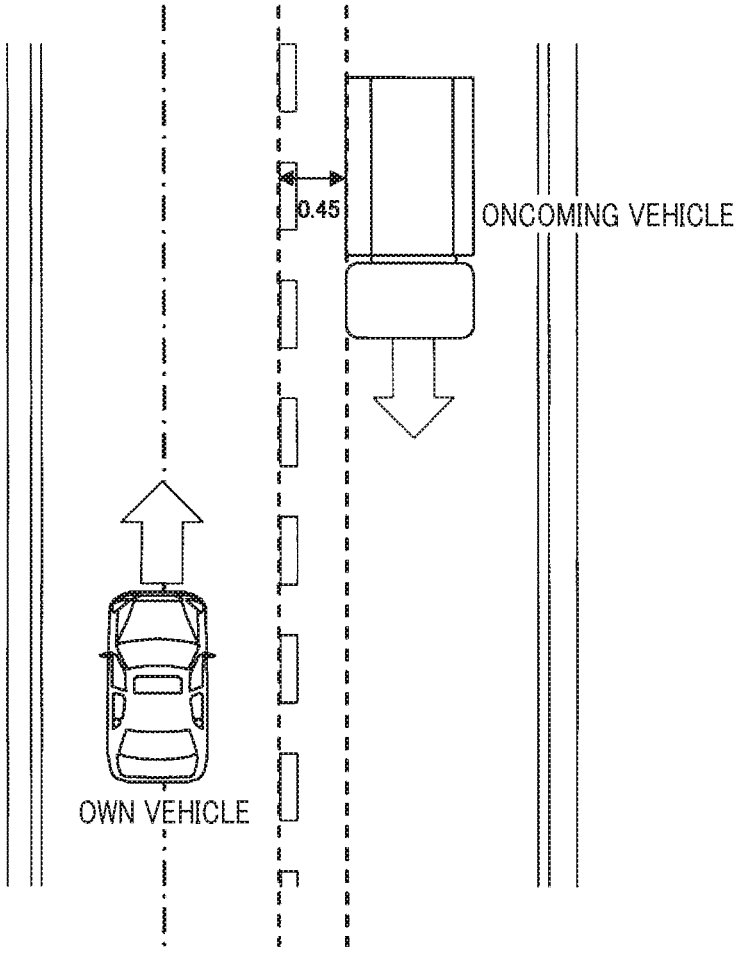
FIG. 14B is a plan view showing surroundings of the own vehicle in the case where the object is an oncoming vehicle.

In addition, as shown in FIG. 14B, when the detected object is an oncoming vehicle, the generation control section 22 displays a vehicle icon 72A and a downward arrow icon 74 representing the approach of the vehicle on the display 40 as shown in FIG. 14A. In this case, the vehicle icon 72A to be displayed is an icon representing an oncoming vehicle in a different color from that of the vehicle icon 72 representing a parallel vehicle, for example. The vehicle icon 72 representing a parallel vehicle and the vehicle icon 72A representing an oncoming vehicle may be set to different pictures.

1-3. Advantageous Effects

According to the first embodiment described above in detail, the following advantageous effects can be obtained.

(1a) In the deviation avoidance apparatus 10 of the deviation avoidance system 2, the boundary detection section 12 acquires the positions of the boundary portions defining the both width-wise ends of the traveling lane in which the own vehicle is traveling, and the object detection section 16 acquires the position of an object around the traveling lane. The generation control section 22 generates the position image, which is an image representing the positions of the boundary portions and the position of the object, and displays the position image on the display device.

According to the deviation avoidance system 2, the position image indicates the positions of the boundary portions and the position of the object, which allows the passenger to recognize favorably the positional relationship between the boundary portions and the object. That is, it is possible to display more items as compared to the conventional technique for displaying an image representing the positions of boundary portions.

(1b) In the deviation avoidance apparatus 10 of the deviation avoidance system 2, the position image includes an image indicating whether the positions of the boundary portions have been successfully acquired.

According to the deviation avoidance system 2, it is possible to allow the passenger to recognize whether the positions of the boundary portions have been successfully acquired.

(1c) In the deviation avoidance apparatus 10 of the deviation avoidance system 2, the positions of the boundary portions on the right and left sides of the traveling lane are acquired, and the position image includes an image indicating whether the position of the boundary portion on the right side of the traveling lane and the position of the boundary portion on the left side of the traveling lane have been successfully acquired.

According to the deviation avoidance system 2, it is possible to allow the passenger to recognize whether the respective positions of the right and left boundary portions have been successfully acquired.

(1d) In the deviation avoidance apparatus 10 of the deviation avoidance system 2, the movement direction of the object is recognized and the position image includes an image representing the movement direction of the object.

According to the deviation avoidance system 2, it is possible to allow the passenger to recognize the movement direction of the object.

(1e) In the deviation avoidance apparatus 10 of the deviation avoidance system 2, the type of the object is recognized and an image representing the type of the object is used to indicate the position of the object.

According to the deviation avoidance system 2, the image corresponding to the type of the recognized object is displayed, which allows the passenger to recognize the type of the object recognized by the display control apparatus.

(1f) In the deviation avoidance apparatus 10 of the deviation avoidance system 2, the relative speed between the own vehicle and the object is recognized, and it is determined whether the object is a vehicle. When the object is a vehicle, it is determined whether the recognized vehicle is a parallel vehicle traveling in the same direction as that of the own vehicle or a non-parallel vehicle traveling in a direction different from that of the own vehicle, based on the relative speed. Then, when the recognized vehicle is a parallel vehicle, an image representing the parallel vehicle is generated, or when the recognized vehicle is a non-parallel vehicle, an image representing the non-parallel vehicle different from the image representing the parallel vehicle is generated. The position image includes the image representing the parallel vehicle or the non-parallel vehicle.

According to the deviation avoidance system 2, when the object is a vehicle, a different image can be displayed in accordance with the running direction of the vehicle. This allows the passenger to recognize that the acquired object is a vehicle and the traveling direction of the vehicle.

(1g) In the deviation avoidance apparatus 10 of the deviation avoidance system 2, it is recognized whether the object is a person, and when the object is recognized as a person, an image representing a pedestrian is generated, and the position image includes an image representing a pedestrian.

According to the deviation avoidance system 2, it is possible to allow the passenger to recognize that the acquired object is a person.

(1h) In the deviation avoidance apparatus 10 of the deviation avoidance system 2, the position image is generated by combining an object icon graphically representing an object and a boundary icon graphically representing a boundary portion.

According to the deviation avoidance system 2, the prepared icons are combined to reduce the process load of generating the image.

(1i) In the deviation avoidance apparatus 10 of the deviation avoidance system 2, as the boundary portion, the recognition result of the suitability boundary indicating the boundary between the unsuitable section 220, which is an unsuitable section for traveling of the own vehicle, and the traveling lane is acquired.

According to the deviation avoidance system 2, even when the both width-wise ends are not strictly defined, it is possible to acquire the boundary with the unsuitable section for traveling of the own vehicle as the suitability boundary.

(1j) In the deviation avoidance apparatus 10 of the deviation avoidance system 2, it is predicted that the own vehicle will deviate from the traveling lane based on the traveling state of the own vehicle traveling on the traveling lane defined by the boundary portions. When the deviation prediction section predicts that the own vehicle will deviate from the traveling lane and there exists an object on or outside the boundary portion on the side on which the own vehicle will deviate from the traveling lane, the traveling control apparatus controlling the traveling state is commanded to suppress the deviation of the own vehicle from the traveling lane such that the maximum movement position, which the own vehicle reaches when moving to the deviation side, is on the more inward side of the traveling lane than that on the occasion when there exists no object on or outside the boundary portion on the side on which the own vehicle will deviate from the traveling lane. The inward side refers to the direction in which the own vehicle comes closer to the desired traveling position as seen from the lateral direction of the traveling lane.

According to the deviation avoidance system 2, at the time of changing the traveling track of the vehicle to fall more inside the traveling lane under the control of suppressing the deviation of the own vehicle from the traveling lane due to the presence of an object around the boundary portion of the traveling lane, it is possible to notify the passenger of the performance of such control by display of the position image.

2. Second Embodiment

2-1. Differences from the First Embodiment

A second embodiment is basically similar in configuration to the first embodiment, and descriptions of the common components will be omitted and differences will be mainly described. The same reference signs as those of the first embodiment indicate the same components as those of the first embodiment, and the foregoing descriptions thereof are incorporated by reference.

The second embodiment is different from the first embodiment in that, in the deviation avoidance process, the mode of image display is set in consideration of the degree of psychological pressure on the driver, in other words, the degree of psychological margin in the driver.

2-2. Process

Figure 15:
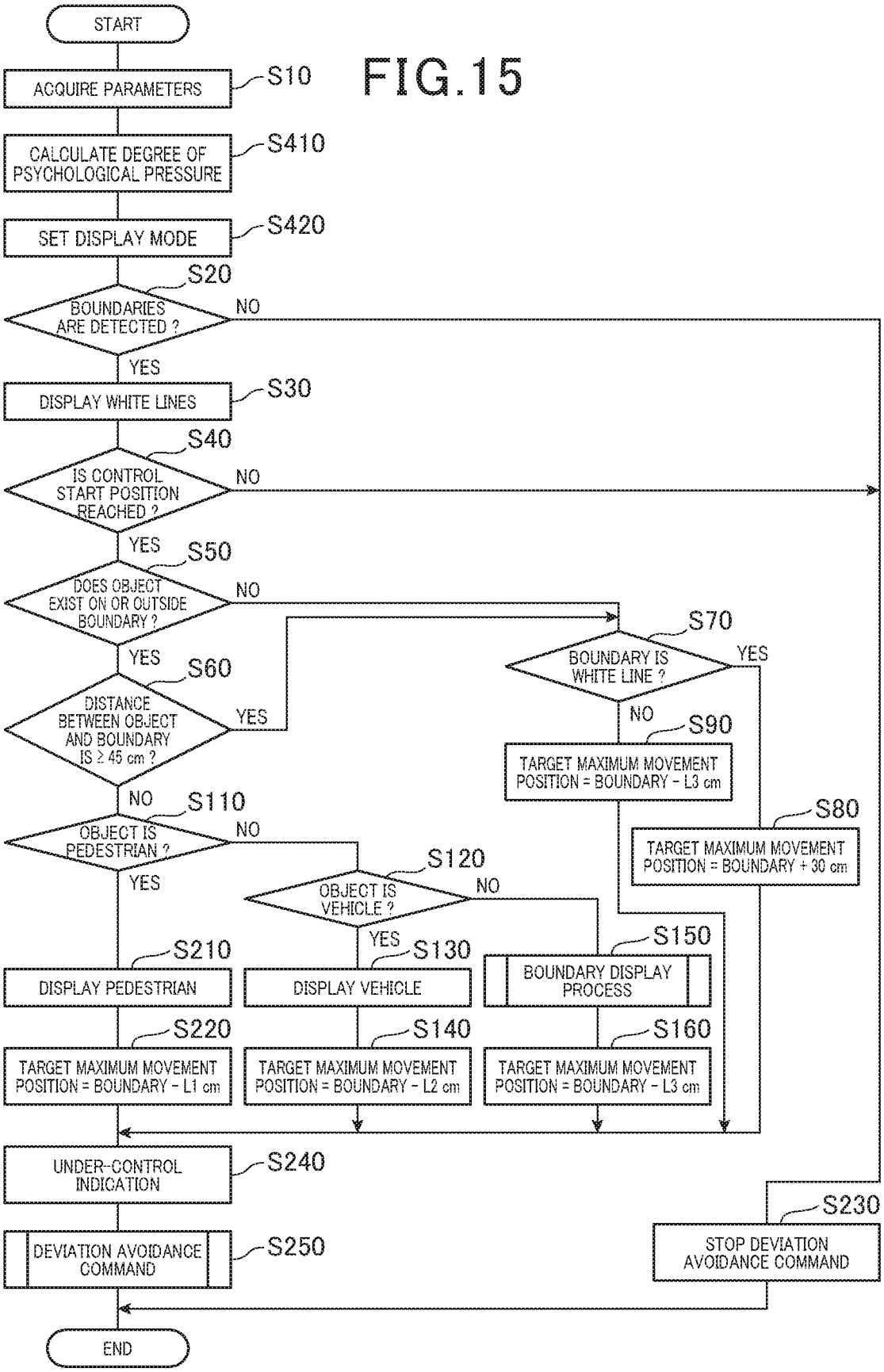
FIG. 15 is a flowchart of a deviation avoidance process according to a second embodiment.

With reference to the flowchart of FIG. 15, a deviation avoidance process performed by the deviation avoidance apparatus 10 in the second embodiment instead of the deviation avoidance process of the first embodiment shown in FIG. 2 will be described. In the deviation avoidance process of the second embodiment, as shown in FIG. 15, S10 is followed by S410 to calculate the degree of psychological pressure.

The degree of psychological pressure refers to the numerical value of fear felt by the driver of the own vehicle about the presence of another vehicle. The degree of psychological pressure is calculated, for example, by using the distance from the object such as another vehicle and the vehicle speed, which is the speed of the own vehicle.

Figure 16:
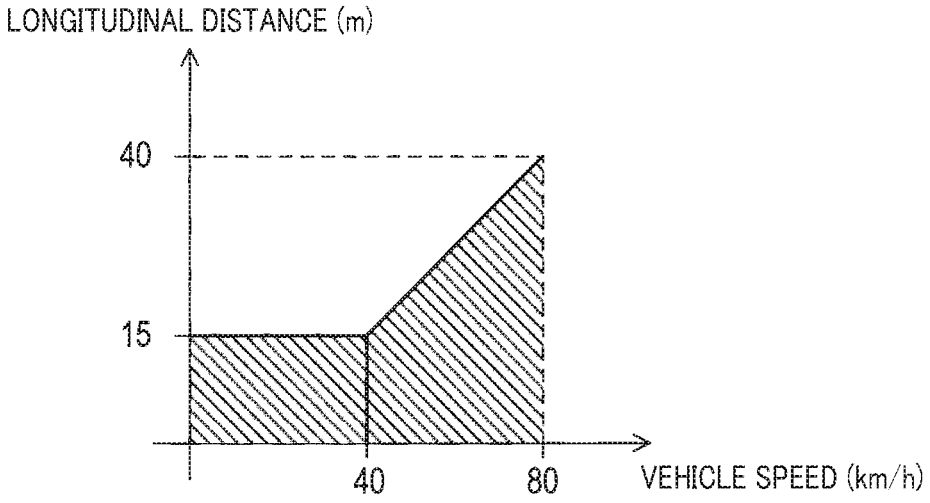
FIG. 16 is an example of a map for use in determining a degree of psychological pressure from a vehicle speed and a longitudinal distance.

Specifically, as shown in FIG. 16, a map is used which has a longitudinal axis indicating the distance from the own vehicle in the traveling direction and a horizontal axis indicating the vehicle speed of the own vehicle. The map indicates that the degree of psychological pressure becomes higher with decrease in the longitudinal distance and with increase in the vehicle speed.

In the map shown in FIG. 16, a threshold is set at a position at which the longitudinal distance is 15 m until the vehicle speed reaches 40 km per hour, and thresholds are set such that the longitudinal distance is longer with increase in the vehicle speed at a vehicle speed of 40 km per hour or more. To calculate the degree of psychological pressure, the relationship between the vehicle speed of the own vehicle and the longitudinal distance to the object is applied to this map such that the degree of psychological pressure becomes higher with increase in the distance to the line segments indicated by the thresholds. However, it is assumed that there is no psychological pressure in the area above the line segments indicated by the thresholds in the map.

Figure 17:
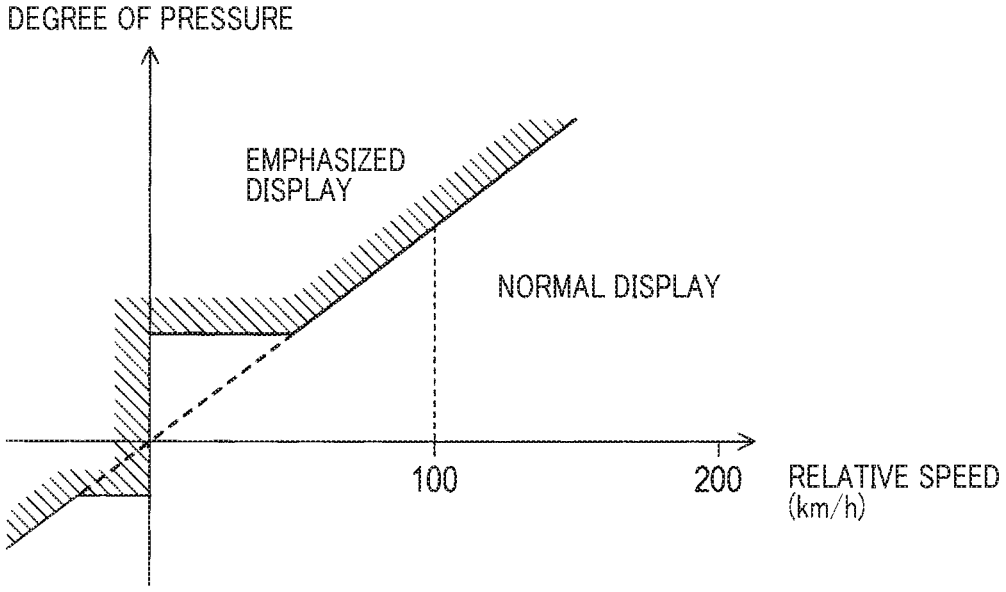
FIG. 17 is an example of a map for use in determining a display mode from a relative speed and a degree of psychological pressure.

Subsequently, in S420, the mode of displaying the vehicle on the display 40 is set. In this process, the display mode is set by using a map for setting the display mode based on the speed relative to another vehicle and the calculated degree of psychological pressure. That is, as illustrated in FIG. 17, the display mode is set depending on whether the position specified in the map by the relative speed and the degree of psychological pressure is located in the area for emphasized display or the area for normal display. The example shown in FIG. 17 is set such that an object with a lower relative speed can be easily displayed with emphasis.

Figure 18A:
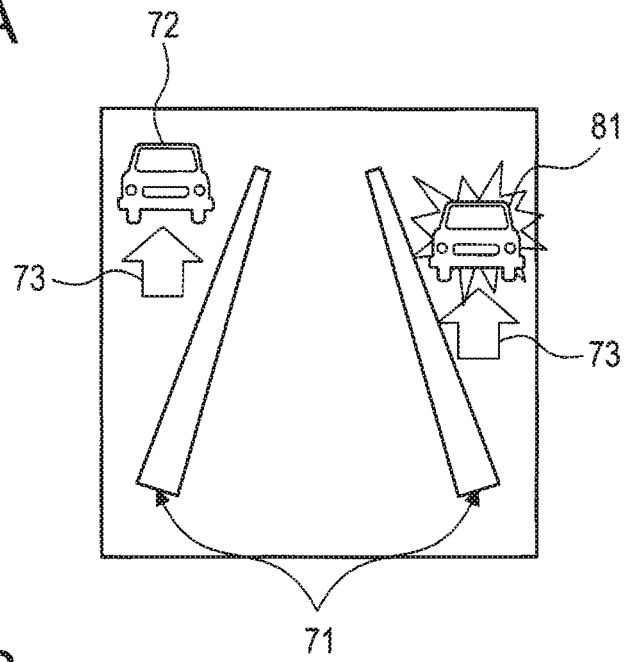
FIG. 18A is a diagram showing a display example of an object having a high degree of psychological pressure.
Figure 18B:
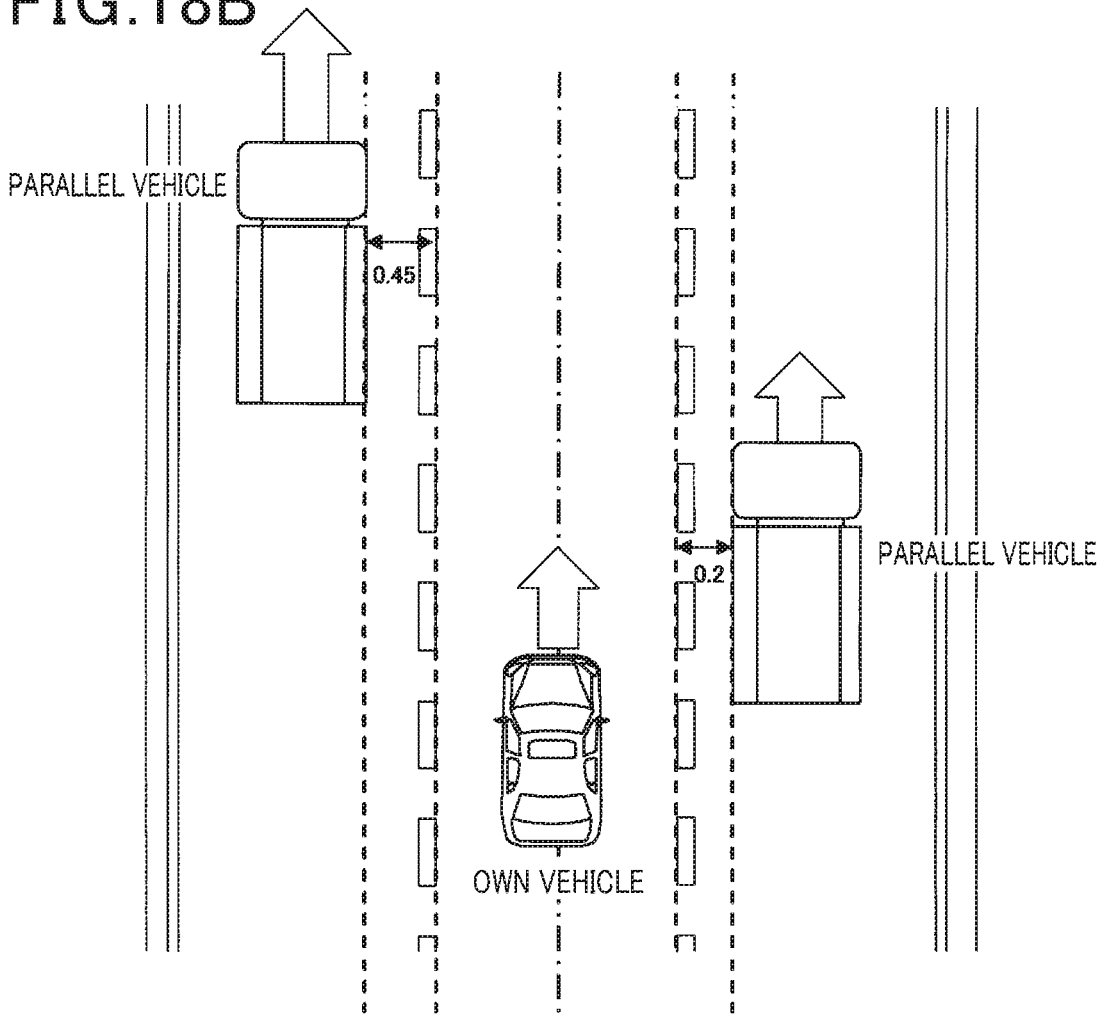
FIG. 18B is a plan view showing surroundings of the own vehicle in the presence of the object having a high degree of psychological pressure.

When the display mode is set for emphasized display, the display of a flashing vehicle icon 81 is set as shown in FIG. 18A, for example. The icon is not limited to a flashing icon but may be any other icon such as a differently colored icon as far as it can attract the driver's attention as compared to the normal vehicle icon 72.

Upon completion of the above process, S20 and the subsequent steps are performed as described above.

2-3. Advantageous Effects

According to the second embodiment described above in detail, the following advantageous effects can be obtained in addition to the advantageous effect (1a) of the first embodiment.

(2a) In the configuration of the second embodiment, the degree of psychological pressure on the driver of the own vehicle is estimated and the mode of image display is changed depending on the degree of psychological pressure. When the degree of psychological pressure is high and the value indicating the burden on the driver of the own vehicle exceeds a threshold, the display mode is changed to attract the driver's attention such that the icon of the vehicle is flashed or the display color is changed to a warning color (for example, yellow or red).

According to the above configuration, it is possible to allow the driver to recognize an object with a high degree of psychological pressure through images.

3. Another Embodiment

The embodiments for implementing the present invention have been described. However, the present invention is not limited to the foregoing embodiments and can be implemented in various forms.

(3a) The deviation avoidance apparatus 10 may be configured such that, as the distance between the acquired position of the object and the position of the boundary portion is longer, the distance between the object icon and the boundary icon is longer in the position image. The object icon refers to an icon representing an object such as a vehicle or a pedestrian, and the boundary icon refers to an icon representing a white line and a suitability boundary.

Figure 19A:
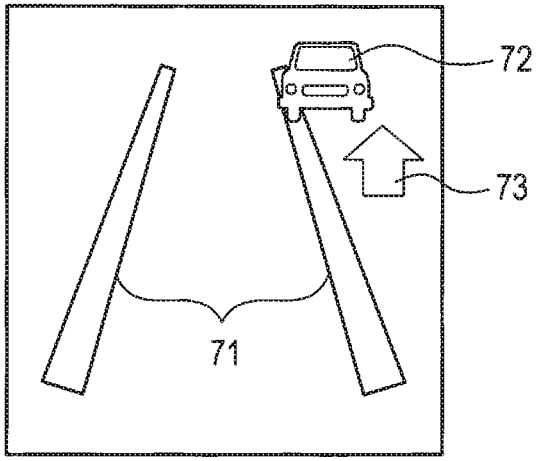
FIG. 19A is a diagram showing a display example in a case where a distance between a white line and an object is short.
Figure 19B:
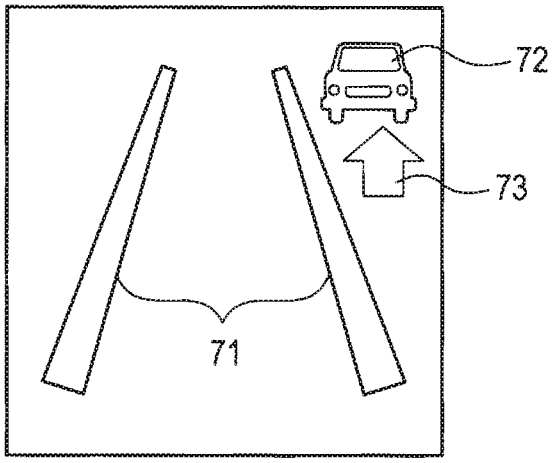
FIG. 19B is a diagram showing a display example in a case where the distance between the white line and the object is medium.
Figure 19C:
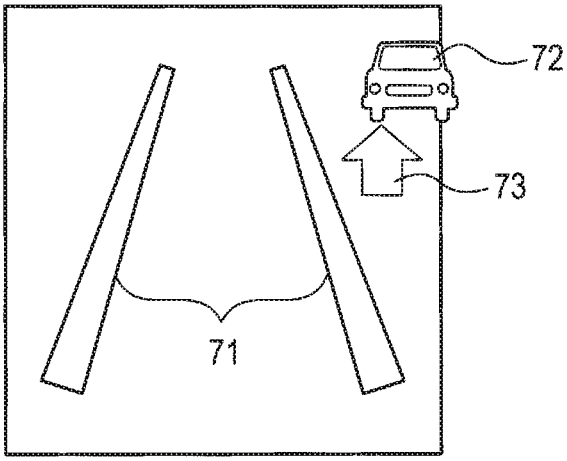
FIG. 19C is a diagram showing a display example in a case where the distance between the white line and the object is long.

For example, as illustrated in FIG. 19A, when the detected vehicle is located on a white line, the vehicle icon 72 is superimposed on the white line icon 71. As illustrated in FIG. 19B, when the detected vehicle is traveling about 30 cm away from the white line, the vehicle icon 72 is slightly separated from the white line icon 71. As shown in FIG. 19C, when the detected vehicle is traveling about 30 cm or more away from the white line, the vehicle icon 72 is more separated from the white line icon 71 than in the case of FIG. 19B.

According to the deviation avoidance system 2, it is possible to express the distance between the object icon and the boundary icon by the position image.

Figure 20:
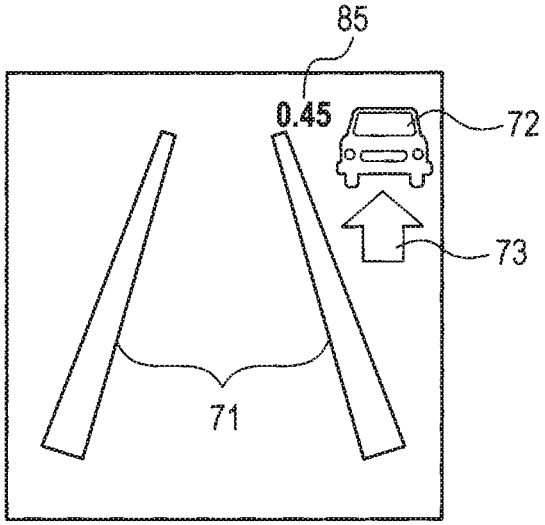
FIG. 20 is a diagram showing a display example in a case where the distance between the white line and the object is represented by a numeric value.

(3b) The deviation avoidance apparatus 10 may be configured to generate the image representing the distance between an object and a boundary portion by a numerical value and include an image representing the distance indicated by a numerical value as the position image. For example, as illustrated in FIG. 20, a numeric icon 85 representing the distance between the white line and the vehicle may be displayed between the white line icon 71 and the vehicle icon 72.

According to the deviation avoidance system 2, it is possible to recognize the distance between an object and a boundary portion by a numeric value in the position image.

(3c) The function of one component in the above embodiment may be distributed to a plurality of components, or the functions of a plurality of components in the embodiment may be integrated into one component. Some of the components in the embodiment may be omitted. At least some of the components in the embodiment may be added to or replaced with components in the foregoing other embodiments.

(3d) Besides the foregoing deviation avoidance system, the present invention can be implemented in various modes such as an apparatus serving as a component of the deviation avoidance system, a program for allowing a computer to function as the deviation avoidance system, a non-transitory substantive recording medium such as a semiconductor memory recording the program, and a deviation avoidance method.

4. The Relationship Between the Components in the Embodiments and the Components in the Present Invention The deviation avoidance apparatus 10 in the foregoing embodiments corresponds to a display control apparatus in the present invention. The boundary detection section 12 in the foregoing embodiments corresponds to a boundary acquisition section in the present invention. The object detection section 16 in the foregoing embodiments corresponds to an object acquisition section in the present invention. The object parameter recognition section 20 in the foregoing embodiments corresponds to a movement recognition section, an object type recognition section, and a relative speed recognition section in the present invention.

In the display control apparatus (10) of the foregoing embodiment, the boundary acquisition section (12) acquires the positions of the boundary portions defining the both width-wise ends of the traveling lane (200) in which the own vehicle travels, and the object acquisition section (16) acquires the position of an object around the traveling lane. The generation control section (22) generates the position image, which is an image representing the positions of the boundary portions and the position of the object, and displays the position image on the display device.

According to the above display control apparatus, the position image indicates the positions of the boundary portions and the position of the object, which allows the passenger to favorably recognize the positional relationship between the boundary portions and the object. That is, it is possible to display more items as compared to the conventional technique for displaying an image representing the positions of boundary portions.

REFERENCE SIGNS LIST

2 . . . Deviation avoidance system,
10 . . . Deviation avoidance apparatus
12 . . . Boundary detection section
14 . . . Deviation prediction section
16 . . . Object detection section
18 . . . Command value adjustment section
20 . . . Object parameter recognition section
22 . . . Generation control section
24 . . . Deviation avoidance section
30 . . . Traveling control apparatus
32 . . . Steering motor
40 . . . Display
50 . . . Deviation avoidance activation switch
54 . . . Camera
56 . . . Acceleration sensor
58 . . . Yaw rate sensor
60 . . . Steering angle sensor
62 . . . Vehicle speed sensor
64 . . . Torque sensor
70 . . . Steering wheel
71 . . . White line icon
72 . . . Vehicle icon
73 . . . Arrow image
74 . . . Arrow icon
78 . . . Under-control icon
82 . . . Guard rail icon
83 . . . Suitability boundary icon
200 . . . Traveling lane
214 . . . Center line
222 . . . Suitability boundary

The invention claimed is:

1. A display control apparatus that is installed in an own vehicle to display images on a display device viewed by a passenger of the own vehicle, the display control apparatus comprising:

a boundary acquisition section that acquires positions of boundary portions defining both width-wise ends of a traveling lane in which the own vehicle travels;

an object acquisition section that acquires a position of an object around the traveling lane;

a movement recognition section that recognizes a movement direction of the object;

a deviation prediction section that determines whether the object is within a predetermined distance from a boundary portion of the traveling lane;

a deviation avoidance section that performs, in response to the object being within the predetermined distance from the boundary portion of the traveling lane, an offset control to move a lateral position of the own vehicle to a side of the traveling lane that is away from the object;

a generation control section that generates a position image on the display device, which is a first icon representing the positions of the boundary portions of the traveling lane and a second icon representing the position of the object and displays the position image on the display device, when the own vehicle travels ahead; and a relative speed recognition section that recognizes a relative speed between the own vehicle and the object, wherein during the offset control, the generation control section displays, together with the position image, an offset icon on the display device indicating that the offset control is being performed and that a travel position of the own vehicle is offset in a width direction of the traveling lane, the position image includes an image representing the movement direction of the object, the display control apparatus calculates a degree of psychological pressure on a driver of the own vehicle, the generation control section changes a display mode of the first icon depending on the calculated degree of psychological pressure and the relative speed between the own vehicle and the object, and when the object is located on the boundary portion, the generation control section displays the first icon representing the positions of the boundary portions of the traveling lane superimposed on the second icon representing the position of the object, when the object is located within the predetermined distance or less from the object, the generation control section displays the second icon located away from the first icon by a first distance, when the object is located more than the predetermined distance from the object, the generation control section displays the second icon located away from the first icon by a second distance, wherein the second distance is longer than the first distance.

2. The display control apparatus according to claim 1, wherein the generation control section includes an image indicating whether the positions of the boundary portions have been acquired, within the position image.

3. The display control apparatus according to claim 2, wherein:

the boundary acquisition section acquires the positions of the boundary portions on right and left sides of the traveling lane, and the generation control section includes, within the position image, an image indicating whether the respective positions of a boundary portion on the right side of the traveling lane and a boundary portion on the left side of the traveling lane have been acquired.

4. The display control apparatus according to claim 1, further comprising an object type recognition section that recognizes a type of the object, wherein the generation control section uses an image representing the type of the object to indicate the position of the object.

5. The display control apparatus according to claim 4, wherein:

the object type recognition section recognizes whether the object is a vehicle, and when the object is a vehicle, recognizes whether a recognized vehicle is a parallel vehicle traveling in the same direction as that of the own vehicle or a non-parallel vehicle traveling in a direction different from that of the own vehicle based on the relative speeds, and the generation control section generates an image representing a parallel vehicle when the recognized vehicle is a parallel vehicle, or generates an image representing a non-parallel vehicle different from the image representing a parallel vehicle when the recognized vehicle is a non-parallel vehicle, and the position image includes the image representing a parallel vehicle or a non-parallel vehicle.

6. The display control apparatus according to claim 4, wherein:

the object type recognition section recognizes whether the object is a person, and when the object is recognized as a person, the generation control section generates an image representing a pedestrian, and the position image includes the image representing the pedestrian.

7. The display control apparatus according to claim 1, wherein the generation control section generates the position image by combining an object icon representing the object as a picture and a boundary icon representing a boundary portion as a picture.

8. The display control apparatus according to claim 1, wherein the generation control section changes a distance between the image representing the object and the image representing a boundary portion to be longer in the position image as a distance between an acquired position of the object and an acquired position of the boundary portion is longer.

9. The display control apparatus according to claim 1, wherein the boundary acquisition section acquires a recognition result of a suitability boundary indicating a boundary between an unsuitable section, which is a section unsuitable for traveling of the own vehicle, and the traveling lane, as a boundary portion.

10. The display control apparatus according to claim 1, wherein the display mode of the first icon is changed depending on the calculated degree of psychological pressure relative to the relative speed between the own vehicle and the object.

11. A display control apparatus that is installed in an own vehicle to display images on a display device viewed by a passenger of the own vehicle, the display control apparatus comprising:

a boundary acquisition section that acquires positions of boundary portions defining both width-wise ends of a traveling lane in which the own vehicle travels;

an object acquisition section that acquires a position of an object around the traveling lane;

a deviation prediction section that determines whether the object is within a predetermined distance from a boundary portion of the traveling lane;

a movement recognition section that recognizes a movement direction of the object;

a deviation avoidance section that performs, in response to the object being within the predetermined distance from the boundary portion of the traveling lane, an offset control to move a lateral position of the own vehicle to a side of the traveling lane that is away from the object;

a generation control section that generates a position image on the display device, which is a first icon representing the positions of the boundary portions of the traveling lane and a second icon representing the position of the object and displays the position image on the display device, when the own vehicle travels ahead; and a relative speed recognition section that recognizes a relative speed between the own vehicle and the object, wherein during the offset control under, the generation control section displays, together with the position image, an offset icon on the display device indicating that the offset control is being performed and that a travel position of the own vehicle is offset in a width direction of the traveling lane, and the generation control section generates an image representing numerically a distance between the object and a boundary portion, and the position image includes the image representing numerically the distance between the object and the boundary portion, the display control apparatus calculates a degree of psychological pressure on a driver of the own vehicle, the generation control section changes a display mode of the first icon depending on the calculated degree of psychological pressure and the relative speed between the own vehicle and the object, and when the object is located on the boundary portion, the generation control section displays the first icon representing the positions of the boundary portions of the traveling lane superimposed on the second icon representing the position of the object, when the object is located within the predetermined distance or less from the object, the generation control section displays the second icon located away from the first icon by a first distance, when the object is located more than the predetermined distance from the object, the generation control section displays the second icon located away from the first icon by a second distance, wherein the second distance is longer than the first distance.

12. A vehicle control apparatus that is installed in an own vehicle to control the own vehicle, comprising:

a boundary acquisition section that acquires positions of boundary portions defining both width-wise ends of a traveling lane in which the own vehicle travels;

an object acquisition section that acquires a position of an object around the traveling lane;

a deviation prediction section that (i) predicts deviation of the own vehicle from the traveling lane based on a traveling state of the own vehicle traveling in the traveling lane defined by the boundary portions acquired by the boundary acquisition section, and (ii) determines whether the object is within a predetermined distance from a boundary portion of the traveling lane;

a movement recognition section that recognizes a movement direction of the object;

a deviation avoidance section that, when the deviation prediction section predicts the deviation of the own vehicle from the traveling lane and the object exists on or outside a boundary portion on a side on which the own vehicle will deviate from the traveling lane, commands a traveling control apparatus to suppress the deviation of the own vehicle from the traveling lane such that a maximum movement position, which the own vehicle reaches when moving to a deviation side, is on a more inward side of the traveling lane than that in a state in which no object exists on or outside the boundary portion on the side on which the own vehicle will deviate from the traveling lane, the deviation avoidance section configured to perform, in response to the object being within the predetermined distance from the boundary portion of the traveling lane, an offset control to move a lateral position of the own vehicle to a side of the traveling lane that is away from the object;

a generation control section that generates a position image, which is an icon representing the positions of the boundary portions and the position of the object, and displays the position image on a display device, when the own vehicle travels ahead; and a relative speed recognition section that recognizes a relative speed between the own vehicle and the object, wherein during the offset control, the generation control section displays, together with the position image, an offset icon on the display device indicating that the offset control is being performed and that a travel position of the own vehicle is offset in a width direction of the traveling lane, the vehicle control apparatus calculates a degree of psychological pressure on a driver of the own vehicle, and the generation control section changes a display mode of the icon depending on the calculated degree of psychological pressure and the relative speed between the own vehicle and the object, when the object is located on the boundary portion, the generation control section displays the first icon representing the positions of the boundary portions of the traveling lane superimposed on the second icon representing the position of the object, when the object is located within the predetermined distance or less from the object, the generation control section displays the second icon located away from the first icon by a first distance, when the object is located more than the predetermined distance from the object, the generation control section displays the second icon located away from the first icon by a second distance, wherein the second distance is longer than the first distance.

13. A method for controlling a display installed in an own vehicle to display images on a display device viewed by a passenger of the own vehicle, the method comprising:

acquiring positions of boundary portions defining both width-wise ends of a traveling lane in which the own vehicle travels;

acquiring a position of an object around the traveling lane;

recognizing a movement direction of the object;

determining whether the object is within a predetermined distance from a boundary portion of the traveling lane;

performing, in response to the object being within the predetermined distance from the boundary portion of the traveling lane, an offset control to move a lateral position of the own vehicle to a side of the traveling lane that is away from the object;

generating a position image on the display device, which is a first icon representing the positions of the boundary portions of the traveling lane and a second icon representing the position of the object and displays the position image on the display device, when the own vehicle travels ahead;

displaying, during the offset control, an offset icon together with the position image; recognizing a relative speed between the own vehicle and the object;

calculating a degree of psychological pressure on a driver of the own vehicle; and changing a display mode of the first icon depending on the calculated degree of psychological pressure and the relative speed between the own vehicle and the object, when the object is located on the boundary portion, the generation control section displays the first icon representing the positions of the boundary portions of the traveling lane superimposed on the second icon representing the position of the object, when the object is located within the predetermined distance or less from the object, the generation control section displays the second icon located away from the first icon by a first distance, when the object is located more than the predetermined distance from the object, the generation control section displays the second icon located away from the first icon by a second distance, wherein the second distance is longer than the first distance, and wherein the offset icon indicating that the offset control is being performed and that a travel position of the own vehicle is offset in a width direction of the traveling lane, and the position image includes an image representing the movement direction of the object.

* * * * *